United States Patent [19]

Bindari

[11] 4,085,600

[45] Apr. 25, 1978

[54] DOUBLE CONTACT LOCKING MECHANISM

[76] Inventor: Ahmed El Bindari, 1217 Beacon St., Brookline, Mass. 02146

[21] Appl. No.: 723,589

[22] Filed: Sep. 15, 1976

Related U.S. Application Data

[63] Continuation-in-part of Ser. No. 646,477, Jan. 5, 1976, abandoned.

[51] Int. Cl.[2] ..... E05B 67/06; E05B 67/22

[52] U.S. Cl. ..... 70/39; 70/53

[58] Field of Search ..... 70/2 L, 38 R, 38 A, 70/38 B, 38 C, 39, 53

[56] References Cited

U.S. PATENT DOCUMENTS

| | | | |
|---|---|---|---|
| 1,384,590 | 7/1921 | Boltone | 70/39 |
| 1,618,924 | 2/1927 | Hanton | 70/53 |

FOREIGN PATENT DOCUMENTS

| | | | |
|---|---|---|---|
| 371,515 | 3/1923 | Germany | 70/39 |
| 686,327 | 3/1965 | Italy | 70/39 |

*Primary Examiner*—Robert L. Wolfe

[57] ABSTRACT

A double contact padlock is provided wherein the locking pin thereof replaces the cam and pins of conventional padlocks and further engages both arms of the padlock shackle to form a high strength padlock. The locking pin bridges the shackle arms and axially rotates into and out of engagement therewith. In a preferred embodiment the locking pin rotates into slots in the shackle arms to secure the shackle. The padlock of the invention can be employed to lock structures, equipment and vehicles including cycles.

In another embodiment of the invention a padlock is provided wherein the upper or arch end of the shackles is of greater width and the lower portion of the shackle is narrower in width near the lock housing, to provide a protective shackle arm overhang at the locking spindle end of such lock housing.

Additionally, a bracket is provided which tightens around the fixed column of, e.g. a steering wheel of a vehicle. A padlock shackle fits over a spoke of the wheel and locks to the bracket, restricting turning of the wheel and securing the vehicle or other equipment.

1 Claim, 26 Drawing Figures

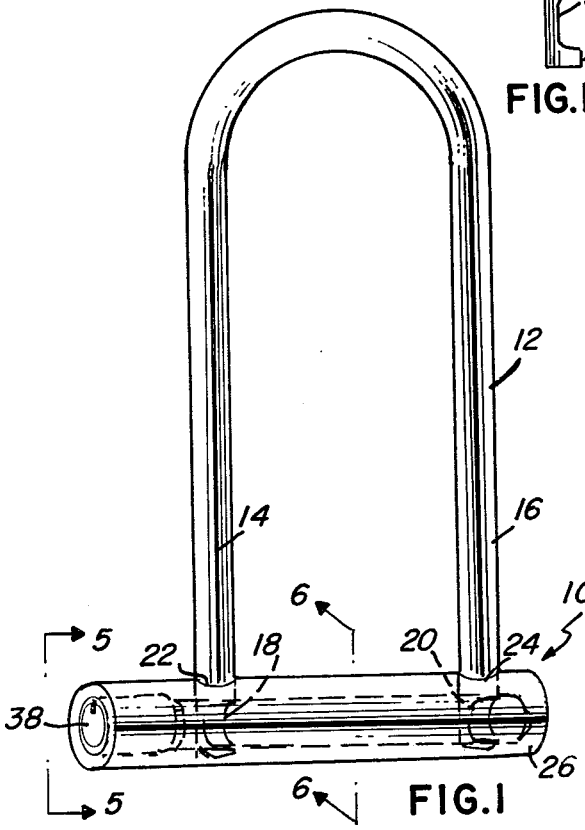
FIG.1
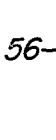
FIG.11
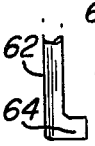
FIG.12
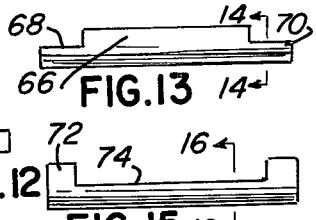
FIG.13
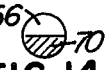
FIG.14
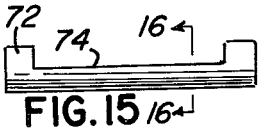
FIG.15
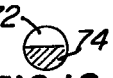
FIG.16
FIG.2
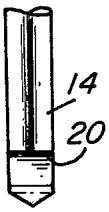
FIG.9
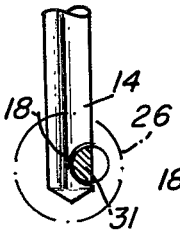
FIG.10
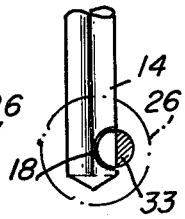
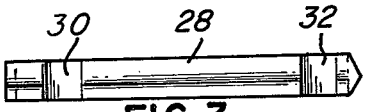
FIG.3
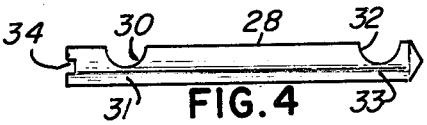
FIG.4
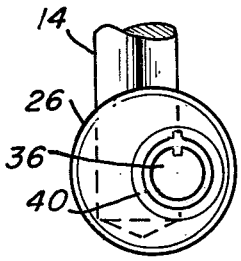
FIG.5
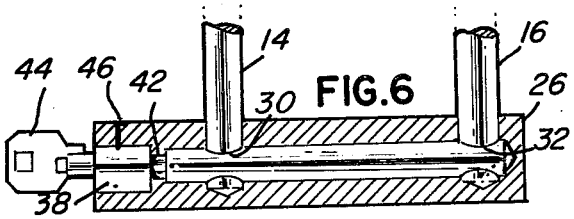
FIG.6
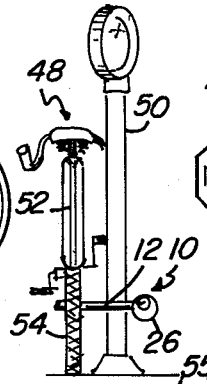
FIG.19
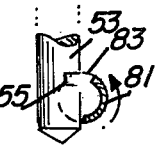
FIG.18
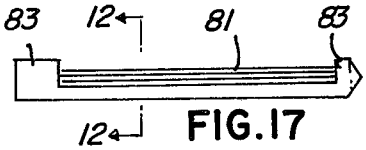
FIG.17
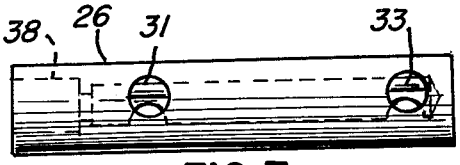
FIG.7
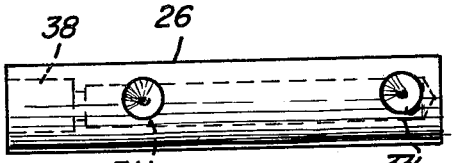
FIG.8

DOUBLE CONTACT LOCKING MECHANISM

This application is continuation-in-part of application Ser. No. 646,477 filed Jan. 5, 1976 and now abandoned.

This invention relates to padlocks, particularly heavy-duty padlocks which apply double locking to the shackles thereof.

THE PRIOR ART

Numerous padlocks have been designed over the years to lock many articles for the protection thereof, including structures and vehicles.

Padlocks generally are constructed of six main components; the housing, the shackle, the cam, the pins or balls and the locking mechanism. Many such padlocks have been susceptible to being pried or broken open, with leverage being applied to the most vulnerable and exposed part thereof, the shackle. Though some padlocks feature shackles secured at but one end, the more pry-resistant and more accepted design has been to secure the shackle at both ends within the padlock housing. In a widely used conventional design, the shackle has a pair of opposed grooves proximate the ends of the arms thereof, on facing inside arm portions. A cam, having an oblong shape, is positioned on a lock cylinder within the padlock housing, the cam being transverse to the grooved arm portions of the shackle and being positioned therebetween, such that, upon turning a key placed in the locking cylinder, the longer axis part of the cam is rotated into engagement with the grooved portions of the shackle. To unlock the padlock and release the shackle, the key and locking cylinder are counter-rotated, turning the cam such that its shorter axis lies between the shackle arms while the longer axis part thereof is rotated out of engagement with the grooved portions of the shackle and into a outwardly projecting position normal to the plane of the shackle. The padlock housing accordingly must be relatively thick, particularly through the middle portion thereof, to provide room for the rotation of the oblong cam into the open position.

While the above rotating cam design has been satisfactory for smaller padlocks, eg. those with a shackle width of from 1 to 1½ inches, for larger width shackle locks, larger oblong cams are required, which causes the padlock housing to become excessively thick and the padlock to become heavy and cumbersome.

Furthermore, the pins which are activated by the cam in between the arms of the shackle are necessarily cantilevered, thus being four times weaker than a pin supported at both ends.

Accordingly, there has not been provided a padlock with a double lock shackle of relatively small housing thickness for various shackle widths, and there is a need and market for such padlock which substantially overcomes the above shortcomings.

There has now been discovered a padlock of improved design which applies double locking to the ends of a shackle for various shackle widths from small to large without the sacrifice of increased housing thickness with increased shackle width.

There is further provided an improved embodiment of the padlock of the invention wherein the shackle is of greater width at the upper or arch end portion, and narrows near the lock housing to overhang same and provide added protection to such housing.

There is further provided a bracket which fastens to one or more padlock shackle arms to extend the locking application thereof to include the steering wheel of vehicles and other like applications.

SUMMARY

Broadly, the present invention provides an improved padlock comprising, a shackle terminating in a pair of spaced arms, said arms each having a lip thereon proximate the ends thereof, a lock pin of sufficient length to bridge said shackle arms, said pin having at least one indented portion which rotates about the longitudinal axis of rotation of said pin, said indented portion being positioned to engage the shackle lips upon axial rotation thereof and to swing clear from said shackle when further rotated; lock housing means for holding said shackle lips and said indented portion in engaging proximity, means to axially rotate said locking pin into locking engagement with said shackle arms and means to further rotate said locking pin to disengage said indented portion from said shackle arms to release said shackle and permit the opening of said padlock.

Also provided is another embodiment of the padlock of the invention comprising a padlock such as described above wherein, however, the upper or arch end portion of the shackle in width, approaches thelength of said lock housing means and the lowr portion of said shackle narrows in width proximate said lock housing means at the locking spindle end thereof.

Further provided is a bracket for use with a padlock in locking a wheel comprising, a clamp having an opening therein for closely fitting around the support column of a wheel, said clamp having at least one aperture therein sized to receive a wheel restraining member and means for opening and closing said clamp around said column.

DESCRIPTION

The invention will become more apparent from the following detailed specifications and drawings in which:

FIG. 1 is an isometric projection of the padlock embodying the present invention;

FIG. 2 is a fragmentary sectional elevation view of a component of the padlock embodiment illustrated in FIG. 1;

FIG. 3 illustrates a plan view of a pin component of a padlock embodying the present invention;

FIG. 4 is a elevation view of the pin component embodiment shown in FIG. 3;

FIG. 5 is an end fragmentary elevation view of a padlock embodiment of the invention shown in FIG. 1 taken on line 5—5, looking in the direction of the arrows;

FIG. 6 is a fragmentary sectional elevation view of the padlock embodying the invention shown in FIG. 1, taken on line 6—6 looking in the direction of the arrows;

FIGS. 7 and 8 are plan views of a component of the padlock embodying the present invention showing closed and open positions of the locking pin;

FIGS. 9 and 10 are side fragmentary sectional elevation views of a component of the padlock of the present invention showing closed and open positions of the locking pin;

FIG. 11 is a side fragmentary sectional elevation view of a component of another padlock embodying the invention;

FIG. 12 is a side fragmentary sectional elevation view of a component of another padlock embodying the invention;

FIG. 13 is an elevation view of another pin component embodiment of the invention;

FIG. 14 is an end elevation view of the pin component of FIG. 13 taken on line 14—14 looking in the direction of the arrows;

FIG. 15 is an elevation view of another pin component embodiment of the invention;

FIG. 16 is an end elevation view of the pin component of FIG. 15 taken on line 16—16 looking in the direction of the arrows;

FIG. 17 is an elevation view of still another pin component embodiment of the invention;

FIG. 18 is a schematic fragmentary elevation view of the pin of FIG. 17 and a shackle component of the padlock embodying the invention;

FIG. 19 is an end elevation view illustrating an application of the padlock embodying the present invention;

Figure 20:
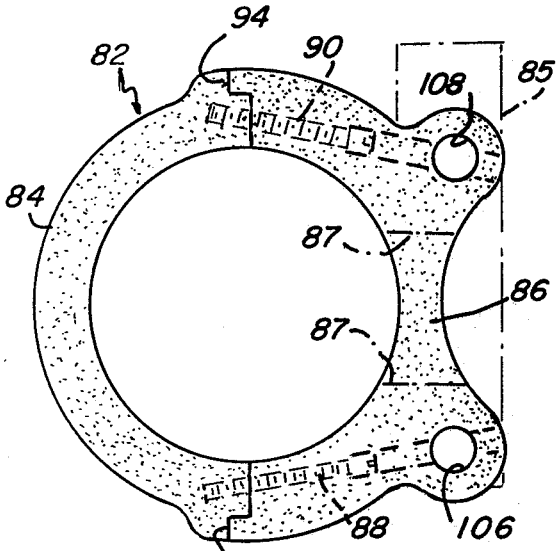
FIG. 20 illustrates a plan view of a bracket component for use with the padlock embodying the present invention.

Referring now to the drawings, heavy duty double lock, padlock 14, has shackle 12 with shackle arms 14 and 16, each of the arms having proximate the end thereof lock pin engaging grooves 18 and 20 inserted into a pair of openings 22 and 24 of the padlock housing 26, as shown in FIGS. 1, 2, 5, 9 and 10. Lock pin 28 having shackle clearing grooves 30 and 32 and lock spindle engaging slot 34, is longitudinally positioned in the padlock housing 26 to bridge the shackle arms 14 and 16 of the shackle 12 in engaging proximity therewith, as shown in FIGS. 1, 3, 4, 5, 6, 9 and 10. The locking pin 28 is positioned in barrel bore 36 in engaging proximity with the shackle arms 14 and 16 such that, upon rotation of the locking pin 28, the indented portions, 31 and 33 swing into the respective grooves 18 and 20 of the shackle arms 14 and 16 to lock the shackle 12 in place in the housing 26 as shown in FIGS. 9 and 7. The locking pin 28 is then further rotated or counter-rotated 180° to swing the indented portions 31 and 33 out of the path of the shackle arms 14 and 16, as shown in FIGS. 10, 8 and 6 to disengage and release the shackle 12 permitting the opening of the padlock 10.

The locking pin 28 is held in place in the housing bore 36 and operated by co-acting with locking spindle or cylinder 38, which is rotationally mounted in bore 40 of the housing 26 and which has stem 42 axially projecting therefrom into the locking pin slot 34 to engage the locking pin 28 to turn the same, as shown in FIGS. 1, 5, 6, 7 and 8.

The locking cylinder 38 is rotated, locked and unlocked by key 44 as shown in FIG. 6. The key locking cylinder and locking pin rotate as one, advantageously 180°, to engage and lock the shackle of the padlock 10 and preferably counter-rotate 180° to clear and thus release the shackle 12 thereof. A dowel pin 46 engages a groove in the locked cylinder 38 and prevents the same from sliding out of the housing bore 40, as shown in FIG. 6.

The padlock of the present invention can be employed to lock various equipment and structures. For example, the padlock 10 secures a bicycle 48 to a post 50, the shackle 12 thereof passing around bicycle frame member 52 through the spokes of bicycle wheel 54 and around the post 50 where the arms thereof are locked in place in the housing 26 of the lock 10 as shown in FIG. 19. In this example, the lock shackle is large enough to lock the bicycle to the post without the necessity of a chain and padlock arrangement.

In a further embodiment of the invention, shackle arm 56 has elongated groove 58 and lip 60, as shown in FIG. 11, while shackle arm 62 has foot, ridge or lip 64, as shown in FIG. 12.

In another embodiment, locking pin 66 has indented portions 68 and 70 for contact with the shackle arms of the invention as shown in FIGS. 13 and 14.

In a further embodiment of the invention, locking pin 72 has indented portion 74 for contact with the shackle arms of the invention as shown in FIGS. 15 and 16.

In another embodiment of the invention, locking pin 76 having axial groove defining hollowed arcuate indented portion 78, is positioned to axially rotate into and out of engagement with groove 80 of shackle arm 81 as shown in FIGS. 17 and 18.

Figure 22:
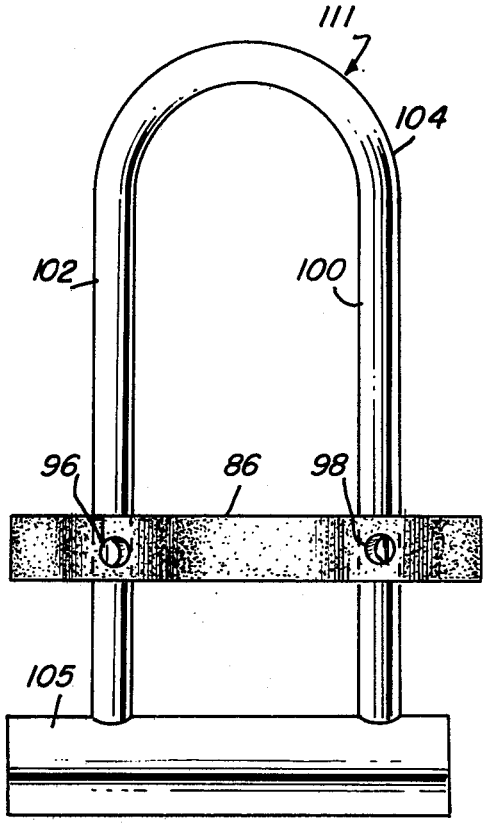
FIG. 22 is an elevation view of the bracket component of FIG. 20 mounted on the padlock embodying the present invention.
Figure 21:
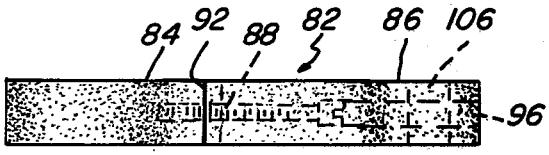
FIG. 21 is an elevation view of the bracket component of FIG. 20.

In another adaption of the padlock of the present invention, annular bracket embodiment 82, having halves 84 and 86 joined together by recessed threaded screws, 88 and 90 is shown in FIGS. 20 and 21. The bracket halves 84 and 90 connect in zigzag joints 92 and 94 to protect the threaded screws 88 and 90 from the hacksaw or chisle as shown in FIGS. 20 and 21. The threaded pins 88 and 90 are installed in the bracket halves 84 and 86 through apertures 96 and 98 which apertures are then blocked by the insertion of the arms 100 and 102 of shackle 104, which pass through bracket apertures 106 and 108, as shown in FIGS. 20, 22 and 21.

In another embodiment as shown by the phantom lines 87 of FIG. 20, the bracket can be open-ended instead of annular, the portion of the bracket between such phantom lines being omitted.

Moreover in another embodiment, the bracket can serve additionally as the padlock housing, i.e. bracket and housing can be merged. For example, the bracket 84 is joined to housing 85, as shown in phantom in FIG. 20.

The padlock and shackle assembly of the invention serve to lock the wheel of a vehicle or other machinery, e.g. valve wheels, by placing the shackle 104 over a spoke 110 of the wheel 112, the annular bracket 82 being fastened around the stationary column 114, the shackle 104 then being passed through the openings 106 and 108 in the bracket 82 and then secured and locked in the padlock housing 105 in the manner discussed above, as shown in FIGS. 23 and 24. The bracket screws 88 and 90 can be tightened to effect a close secure fit around the wheel column 114 and, upon installation of the padlock assembly 111, securely locks the wheel 112 in place against unauthorized turning thereof including attempted theft of a vehicle, eg. a motor vehicle. Alternatively, a small padlock and chain can pass through, e.g. bracket aperture 106 and around wheel spoke 110 and back to such small padlock (not shown) to lock said wheel of FIGS. 23 and 24.

Figure 25:
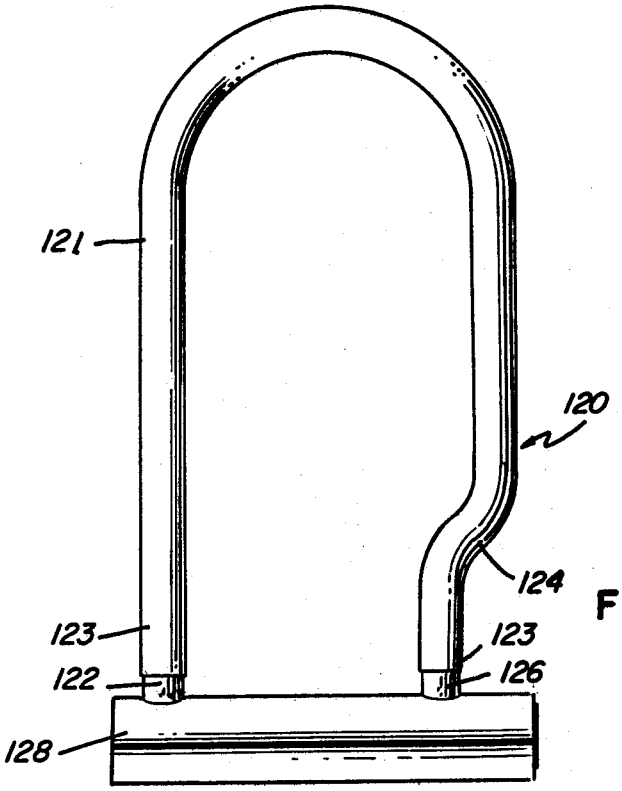
FIG. 25 is an elevation view of another embodiment of the padlock of the present invention and FIG. 26 is an elevation view of the bracket component of FIG. 20 mounted on the padlock embodiment of FIG. 25.

In another embodiment, padlock 120 has shackle 121 with shackle arms 122 and 126 which engage the lock housing 128, as shown in FIG. 25. The first shackle arm 122 extends straight from the shackle arch while the other shackle arm extends parallel to the first arm, then bends inwardly at bent segment 124, toward the first arm, then bends again to parallel the first arm at a closer separation, proximate the lock housing 128 as shown in FIG. 25. A plastic sleeve 123 encloses the shackle 121 as shown in FIG. 25.

The purpose of the bent shackle is to provide a shackle arm overhang near the end of the lock housing to deflect or interfere with hammer blows applied to such housing and locking spindle to thus protect same from attempts to force the padlock open. A further benefit of this embodiment is the increased width of the upper portion of the shackle which eases the installation thereof around larger anchoring means.

Figure 26:
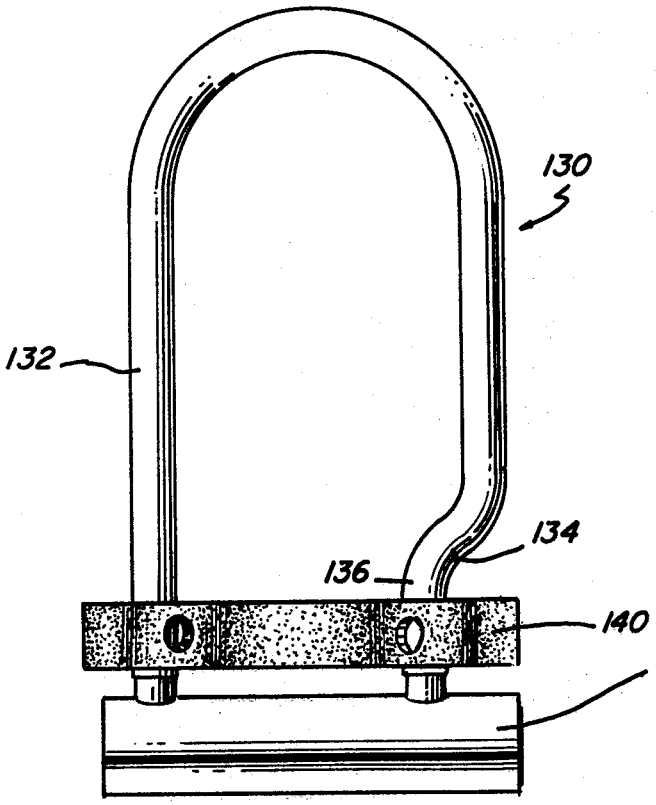

In a further adaptation of the padlock of the invention, shackle arms 132 and 136 of padlock 130 are inserted through mating apertures (not shown) of annular bracket 140 (which is like the annular bracket 86 shown in FIGS. 20, 21 and 22) into lock housing 138 as shown in FIG. 26.

Figure 23:
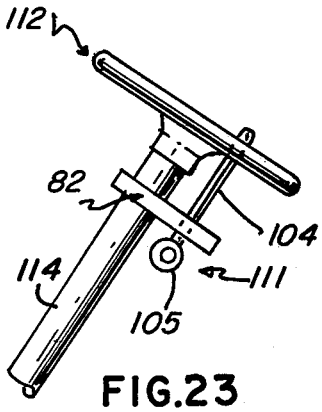
FIG. 23 is an elevation view of the padlock and bracket component embodying the present invention mounted on a vehicle steering wheel and FIG. 24 is a plan view of the padlock and bracket component embodying the present invention mounted on the vehicle steering wheel of FIG. 23.
Figure 24:
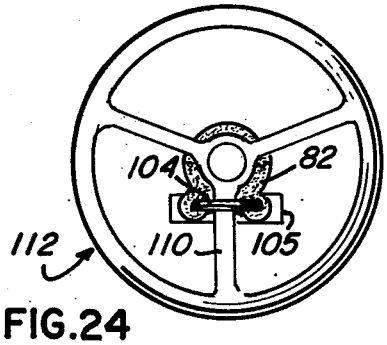

The shackle arm bend 134, serves to lock the bracket 140, and the padlock 130 in position relative to each other, as shown in FIG. 26 and further indicated in FIGS. 23 and 24.

Accordingly, if a thief cuts the shackle enclosed steering wheel spoke 110, shown in FIG. 24, he can not pound the shackle downwardly through the bracket out of the way and the shackle continues to be locked in place to hinder steering of a vehicle by blocking extensive rotation of the remaining steering wheel spokes.

From the above description it can be seen that the present double padlock of the present invention provides an improved relatively light-weight, heavy-duty padlock of various locking applications.

As described above, the locking pin of the padlock of the invention replaces both the rotating cam and sliding pins (or balls) of the padlocks of the prior art. In addition, as stated above, the inherent weakness of the cantilevered locking structure of the prior art is replaced by the much stronger locking pin mechanism of the present invention, which pin securely engages both arms of the shackle.

The padlock of the invention has reduced number of components which can be made by relatively simple machining operations and/or castings. The padlock of the invention has a high strength to weight ratio and can be made of metal suitable for easy machining yet with good hardenability characteristics.

As stated, the shackle arms and locking pin are preferably cylindrical and co-act with matching grooves in close clearance, as shown in FIGS. 9 and 10 for high strength to weight ratio. Advantageously, the shackle arms and locking pin are of the same diameter and material. A preferred embodiment is illustrated in FIGS. 1 and 6. An important feature of the invention is that while the locking cams of the padlocks of the prior art are of cantilevered mounting, the locking pin of the invention is supported at both ends to provide much greater structural strength and resistance than heretofore available.

Where the shackle and pin are grooved to half their thickness at the point of contact, eg. FIG. 9, and have two points of contact, e.g. FIGS. 1 and 6, an attempt to force the lock will require a force equal to or greater than the shearing strength of the materials employed for the equivalent thickness thereof. In general, the shearing strength of metals is about half the tensile strength thereof. Accordingly, with both arms of the shackle engaged by the locking pin, a failure of the padlock requires a pull of twice the shearing strength or about the tensile strength of the shackle, a significant deterrent.

The housing of the padlock can be of various angular and rounded shapes as desired, and preferably is oblong in the direction of bridging the separation between the shackle arms. The padlock housing has at least two apertures therein to receive at least portions of the shackle arms therein. These openings or bores can take various shapes, according to the cross-sectional shapes of the shackle arms and desirably receive such arms in a relatively close clearing fit.

The housing further has an aperture or bore to contain the locking pin of the invention, which aperture positions the pin to bridge the gap between the shackle arms in engaging proximity therewith, i.e. the pin can readily be moved into and out of contact with the shackle arms. In the embodiment illustrated in FIG. 1, the shackle openings are positioned proximate the longitudinal axis of the lock housing and at right angles therewith, while the locking pin bore is offset from such longitudinal axis, as illustrated in FIG. 5, to maintain the pin and shackle arms in the proper locking and releasing relationship.

The shackle of the padlock of the invention can have various cross-sectional shapes from angular (e.g. bent bar) to rounded, including oval and circular or other rounded shapes. Preferably, the shackle arms are rounded, e.g. of cylindrical shape.

The shackle can take various shapes, e.g. U-shaped, or oval or rounded. One or both shackle arms can have a bend therein as desired. The bend (or bends) can take various rounded shapes but should be positioned on the shackle arm proximate the lock housing as indicated above. Preferably one shackle arm is bent to provide a protective shackle arm overhang at the locking spindle end of the lock housing, when the shackle is installed therein as discussed above.

The shackle arms can have several different locking pin engaging surfaces within the scope of the present invention herein called lips. Such pin engaging surfaces can include a grooved lip portion as illustrated, for example, in FIGS. 9 and 10 of the drawings, as well as other lip portions, e.g. a foot or flange 60 and 64, illustrated in FIGS. 11 and 12 of the drawings. Preferred is the recessed lip or groove 18, illustrated in FIGS. 9 and 10.

The locking pin of the invention can take various cross-sectional shapes, including angular and rounded, e.g. a bar or a cylinder, provided there is sufficient room for it to axially rotate in the housing bore. Several examples of these various shaped pins are illustrated in FIGS. 3 and 4 and 13 to 18.

The locking pin can engage the shackle arms with its indented portions. By "indented portions," as used herein, is meant, grooved portions, e.g. portions 31 and 33, illustrated in FIGS. 9 and 4, as well as indented portions of the pins shown in FIGS. 13 to 18 and the like. These indented portions are positioned and spaced to align and engage the lip portions of the cooperating shackle arms described above.

The locking pin desirably has at one end thereof, a means to engage a locking spindle which can be a ridge, a groove and the like and is preferably a groove. The locking spindle is positioned in the housing to axially align with the rotating axis of the locking pin and has a mating ridge or groove to fit the locking pin so the two turn together. The locking spindle can take various shapes but is desirably cylindrical and is readily turned by the appropriate unlocking means. A preferred unlocking means, a key, turns the locking spindle, which also turns the locking pin into and out of engagement with the lip portions of the shackle arms. In a preferred embodiment, the locking spindle and locking pin rotate 180° into locking engagement with the lips of the shackle arms and counter-rotate 180° to release the shackle and permit the padlock to be opened.

Preferably for greater strength to weight ratio, the shackle arms, the locking pin and the locking spindle are circular in cross-sectional shape and are positioned in cylindrical apertures or bores in the padlock housing. The padlock housing is desirably cylindrical also.

The padlock components are desirably made of readily machinable steels with good hardenability characteristics, including case hardenability. Examples are steels alloyed with nickel, chromium and molybdenum.

The double lock padlock of the present invention can come in various sizes, depending upon the application desired. It can be relatively small for locking a door of a structure or vehicle, e.g. where a chain is employed therewith, or it can be larger for larger applications, e.g. locking a cycle as shown in FIG. 19 or a steering wheel, as shown in FIGS. 23 and 24. In other words, the size depends upon application and the size, weight and strength requirements of the padlock of the invention.

Further, as described above, the padlock of the invention is advantageously used with a cooperating locking bracket to extend the uses thereof. The bracket includes a clamp of open-ended or annular shape for fitting around a support column of a wheel, e.g. a steering column of a vehicle. The bracket, additionally, has one or more apertures therein for securely holding one or both of the shackle arms of a padlock as described above.

The bracket can take various shapes, provided it can be secured around a column or other structure and receive, e.g. in aperture 106 of FIG. 20, one or both the shackle arms of a padlock and/or a chain therein. Moreover, the bracket can, as stated above, contain the padlock housing. The padlock is desirably of hardenable steel as discussed previously with regard to the padlock components.

Advantageously, the bracket is made of at least two components held together by fastening means of various types which protect it from prying or sawing in an attempt to break the padlock assembly of the invention. Further the padlock can be of two hinged sections and fastened by one screw. An important feature of the bracket of the invention is the offset seam, e.g. seam 92 of FIG. 20, which resists the applications of a hacksaw to sever the bracket screws.

The bracket, like the padlock of the present invention, can be of various sizes, depending on the application, provided it fits the padlock and the structure to which it is attached. The bracket moreover can be employed with various other padlocks available. Moreover, the bracket can be employed with a small padlock and chain, e.g. to lock a wheel as discussed above.

Where the padlock and/or the bracket of the invention are carried about on a vehicle, e.g. a bicycle or other vehicle, they will readily fit in a carrier clamp which is attached to such bicycle or vehicle.

What is claimed is:

1. A padlock comprising a shackle terminating in a pair of spaced arms, said arms each having a lip thereon proximate the ends thereof, a locking pin of sufficient length, to bridge the shackle arms, said pin having at least one indented portion which rotates about the longitudinal axis of rotation of said pin, said indented portion being positioned to engage both shackle lips upon axial rotation thereof and to swing clear from said shackle arms when further rotated, lock housing means for holding said shackle lips and said indented portion in engaging proximity, means to axially rotate said locking pin into locking engagement with said shackle arms and means to further rotate said locking pin to disengage said indented portion from said shackle arms to release said shackle to permit the opening of said padlock;

one of said shackle arms extending substantially straight to the end thereof and the other of said shackle arms extending substantially parallel to the first arm part way then bending inwardly toward said first arm then bending again to substantially parallel said first arm proximate said lock housing means to provide a protective shackle arm overhang which prevents direct blows to the lock housing said overhang limited to the axial extent of said lock housing.

* * * * *